US009114049B2

(12) United States Patent
Callahan

(10) Patent No.: US 9,114,049 B2
(45) Date of Patent: Aug. 25, 2015

(54) ROTATING PLATFORM FOR WHEELCHAIR BOUND PEOPLE

(76) Inventor: Ronald J Callahan, Poughkeepsie, NY (US)

( * ) Notice: Subject to any disclaimer, the term of this patent is extended or adjusted under 35 U.S.C. 154(b) by 0 days.

(21) Appl. No.: 12/931,525

(22) Filed: Feb. 3, 2011

(65) Prior Publication Data

US 2011/0127402 A1 Jun. 2, 2011

Related U.S. Application Data

(63) Continuation-in-part of application No. 12/322,152, filed on Jan. 29, 2009, now abandoned.

(51) Int. Cl.

| | |
|---|---|
| ***A47B 91/00*** | (2006.01) |
| ***A47B 95/00*** | (2006.01) |
| ***A61G 5/10*** | (2006.01) |
| ***A61G 3/02*** | (2006.01) |

(52) U.S. Cl.
CPC .. *A61G 5/10* (2013.01); *A61G 3/02* (2013.01); *A61G 2005/1051* (2013.01)

(58) Field of Classification Search
USPC ..... 248/349.1, 346.01, 917; 108/20–22, 108/137, 139, 142, 103
See application file for complete search history.

(56) References Cited

U.S. PATENT DOCUMENTS

| | | | | |
|---|---|---|---|---|
| 4,339,224 | A | 7/1982 | Lamb | |
| 4,555,990 | A * | 12/1985 | Egawa | 108/20 |
| 4,690,364 | A | 9/1987 | Constantin | |
| 4,754,946 | A | 7/1988 | Constantin | |
| 4,759,684 | A * | 7/1988 | Lanzillotta et al. | 414/678 |
| 4,934,843 | A * | 6/1990 | Nakanishi | 384/613 |
| 4,966,362 | A * | 10/1990 | Ramaekers | 482/148 |
| 5,220,116 | A * | 6/1993 | Sheets | 42/94 |
| 5,261,779 | A * | 11/1993 | Goodrich | 414/546 |
| 5,344,265 | A * | 9/1994 | Ullman et al. | 410/3 |
| 5,391,030 | A * | 2/1995 | Lee | 410/12 |
| 5,794,908 | A * | 8/1998 | East et al. | 248/503.1 |
| 5,884,929 | A | 3/1999 | Kincaid | |
| 6,343,908 | B1 * | 2/2002 | Oudsten et al. | 414/537 |
| 6,568,646 | B2 * | 5/2003 | Wess et al. | 248/349.1 |
| 7,040,248 | B1 * | 5/2006 | Whitfield | 114/364 |
| 2004/0000440 | A1 * | 1/2004 | Sawyer | 180/13 |

* cited by examiner

*Primary Examiner* — Terrell McKinnon
*Assistant Examiner* — Michael McDuffie
(74) *Attorney, Agent, or Firm* — Saile Ackerman LLC; Stephen B. Ackerman; Rosemary L. S. Pike

(57) ABSTRACT

A method and apparatus for rotating a wheelchair on a motorized rotatable platform comprising providing a motorized rotatable platform comprising a stationary bottom plate and a rotatable top plate supported by a central conical bearing assembly and a circular ring thrust bearing, wherein rotation of the top plate is accomplished by an electric motor/gearbox assembly fastened onto the top plate, driving the wheelchair onto the motorized rotatable platform, anchoring the wheelchair to the top plate and switching electrical power from the wheelchair's electric motor to the electric motor/gearbox assembly, rotating the wheelchair to a desired position using the wheelchair's controls, and disengaging anchoring of the wheelchair and switching electrical power back to the wheelchair's electric motor, and driving the wheelchair off the platform.

22 Claims, 4 Drawing Sheets

ROTATING PLATFORM FOR WHEELCHAIR BOUND PEOPLE

This application is a Continuation-in-Part application of U.S. Ser. No. 12/322,152, filed on Jan. 29, 2009 now abandoned, which is herein incorporated by reference in its entirety.

BACKGROUND OF THE INVENTION (1) Field of the Invention

The invention relates to the design and operation of a lightweight portable turntable for rotating a wheelchair in tight quarters.

(2) Description of Related Art

Conventional wheelchairs or powerchairs, in particular rear wheel drive chairs, are not designed to rotate on a central axis and are difficult to maneuver in tight quarters and cannot rotate or turn on a short axis like modern mid wheel drive powerchairs which can rotate on a short axis. However, the rear wheel drive powerchairs are far more suitable for travel over rough terrain such as in fields or in wooded areas. Situations are encountered wherein the ability to rotate a wheelchair in tight quarters is required in sporting events wherein travel over rough terrain is required to reach a position where short axis rotation is desirable. Examples of such occasions include hunting and fishing trips. To overcome this problem it is desirable to provide a separate turntable for the powerchair at the short axis location.

Wheelchair turntables have been described for various applications. However, safety concerns have not been sufficiently addressed. These concerns become particularly important when the wheelchair is in motion, such as in a car or bus. Moreover, applications for modern, motororized and therefore heavy wheelchairs have also not been sufficiently addressed.

Wess, et. al., in U.S. Pat. No. 6,568,646 describes a circular turntable mounted rotatably on a base. In one embodiment, the turntable is supported by central conical roller bearings assisted by anti-friction pads between turntable and the base. In a second embodiment the turntable is supported by ring bearings formed by multiple plastic spheres disposed in two circular grooves in the base, concentric with the turntable. Wess provides a rod which effectively locks the turntable to the base of the unit, thereby preventing the table from rotating during positioning of the wheelchair or when the table is not occupied.

Lamb, U.S. Pat. No. 4,339,224 describes a circular compartment containing multiple turntables to accommodate wheelchairs in a public transportation vehicle such as a bus. A padded center-post and padded walls are provided as cushioning for the chair and its occupant in the event of a sudden jolt of the vehicle. However, no provisions are made to secure the wheelchair itself, much less the occupant.

Whitfield, U.S. Pat. No. 7,040,248 B1 shows a turntable for holding a wheelchair on a boat or truck. The chair is fastened to the turntable with U bolts and the turntable is stabilized against vehicle movements.

Constantin, U.S. Pat. Nos. 4,690,364 and 4,754,946, teaches a wheelchair supporting platform onto which the wheelchair is securely fastened with bolts. The platform is rotatably mounted onto a base by a shaft which extends through an opening in the base. In operation, the shaft is fitted with a retaining washer which permits rotation but does not permit the shaft to be pulled out of the opening. Thereby the wheelchair can be safely secured in a moving vehicle, Lanzillotta, et. al., U.S. Pat. No. 4,759,684 teaches, a wheelchair supporting platform which raises the wheelchair in the manner of a barber chair and also permits rotation thereof. The wheelchair is rolled onto the platform but is in no way secured to the platform.

Sheets, U.S. Pat. No. 5,220,116, describes a rotatable shooting platform for a quadriplegic which has front and rear stops against the wheels of a wheelchair to prevent its forward or backward movement. This is particularly important to prevent gun recoil from driving the chair backwards and off the platform. However, these stops, which are permanently fastened to the platform, make it difficult to subsequently move the wheelchair off the platform. In a second embodiment, a reversible electric motor, operated by the hand of the occupant, rotates the turntable.

SUMMARY OF THE INVENTION

Battery powered wheelchairs are quite abundant today and are particularly well suited to the quadriplegic. The power supply of the wheelchair can be utilized not only to drive the chair, but also in this invention, to operate the turntable when the chair is engaged thereon. Further, the power supply can also be used to enable safety features, in particular, by switching power and control from the chair to the turntable, only after the chair has been secured to the turntable. Not only does this provide stability in a moving vehicle but also prevents the chair from being accidentally driven while it is latched to the turntable.

More specifically, it becomes an object of this invention to power the turntable with either the wheelchair's power supply or a separate battery. The wheelchair can optionally be driven onto the turntable and into a latch which locks the chair to the platform. The occupant's control can be simultaneously shifted from the chair to the turntable, while also engaging any other safety devices. Disengaging from the turntable and transferring control back to the chair is only allowed when the turntable is in the proper discharge position. All of these operations can be entirely and safely under control of the chair's occupant.

It is another object of this invention to provide a design for a lightweight, high capacity, motorized, and portable wheelchair turntable which can be safely, independently and conveniently operated by wheelchair-bound person.

It is another object of this invention to provide a design for a lightweight, high capacity, motorized, and portable wheelchair turntable wherein electric power is provided by an external battery.

It is another object of this invention to provide a design for a lightweight, high capacity, and portable wheelchair turntable wherein electrical power and control can be automatically transferred from a powerchair to the turntable when the powerchair engages the turntable and is returned to the powerchair when the occupant disengages the turntable.

It is yet another object of this invention to provide a design for a lightweight, high capacity wheelchair turntable which can be mounted, engaged, operated, and dismounted, with ease and confidence, entirely under the control of a wheelchair-bound person.

These objects are accomplished by a turntable consisting of a stationary bottom plate and a rotatable top plate supported by a central conical bearing assembly and a large diameter circular bearing. Rotation of the top plate is accomplished by an electric motor/gearbox assembly fastened onto the top plate which drives a small sprocket residing between the two plates. The small sprocket drives a chain which also engages a large sprocket, said large sprocket being fastened securely to the lower plate.

Electric power can be supplied to the motor by a battery which also powers the wheelchair. The powerchair is driven onto the rotatable platform over a short ramp which can be retracted after the chair passes over it. The chair may then mount a fifth-wheel hitch assembly where a hitching pin anchors the chair to the turntable, and can also switch electrical power from the chair's electric motor to the motor on the turntable. This now secures the chair and prevents any accidental motion thereof. This is particularly important if the platform is used in a moving vehicle or a boat. In addition, the occupant's control of the motion of the chair is now switched over to control of the table rotation. Operational control, for example by a chin controller or other joystick type control 55, is also transferred to the turntable. Return of power and control to the wheelchair is optionally accomplished by ejecting the hitching pin with a solenoid attached beneath the hitch assembly.

Alternately, the turntable may be provided with its own battery mounted thereon. In this case, only the wheelchair's control is transferred to the turntable when the turntable is in service. This can be done either by a hard wire connection 53, made at the time that the chair becomes latched to the turntable, or, by utilizing a joystick or chin control 55 which transmits a radio signal (not shown) to a receiver on the turntable which, in turn, operates the table.

BRIEF DESCRIPTION OF THE DRAWINGS

In the accompanying drawings forming a material part of this description, there is shown.

DESCRIPTION OF THE PREFERRED EMBODIMENTS

Figure 1:
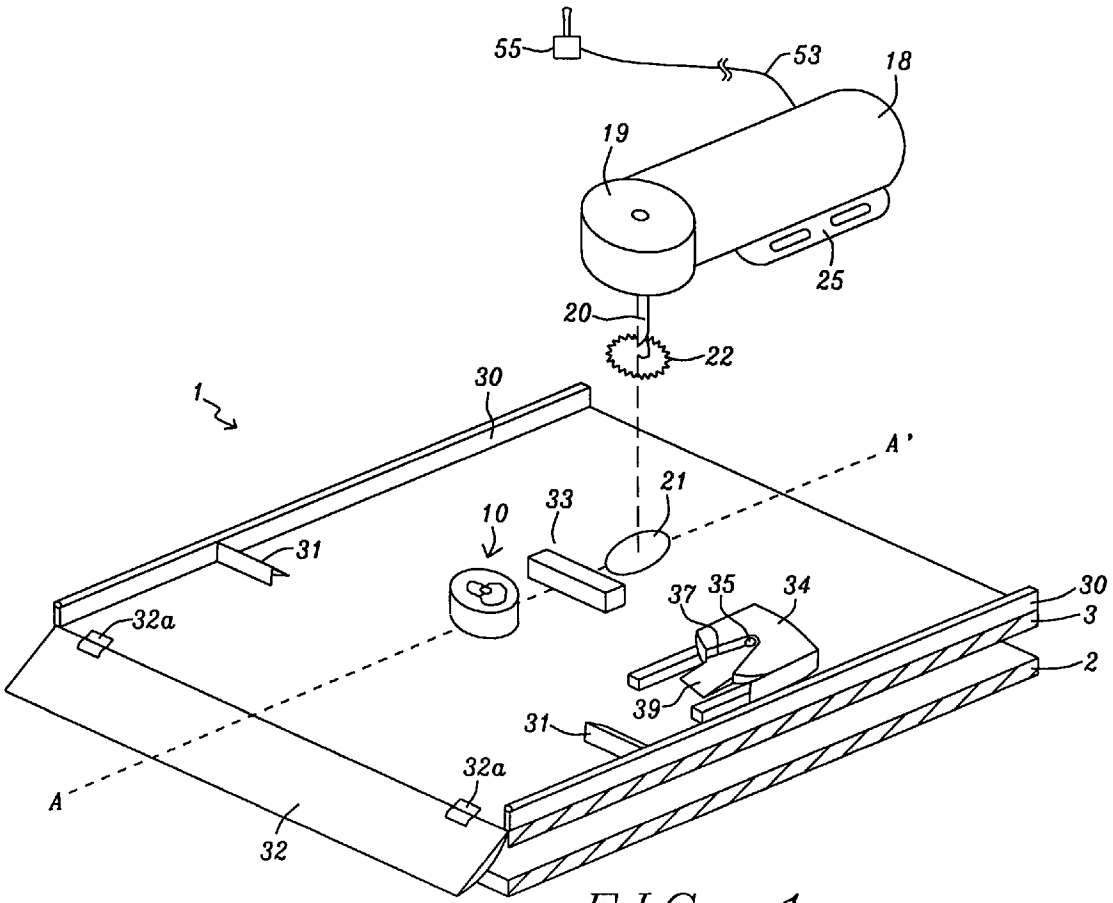
FIG. 1 is an isometric view of the turntable according to a first embodiment of the present invention illustrating the components on the top surface.
Figure 2:
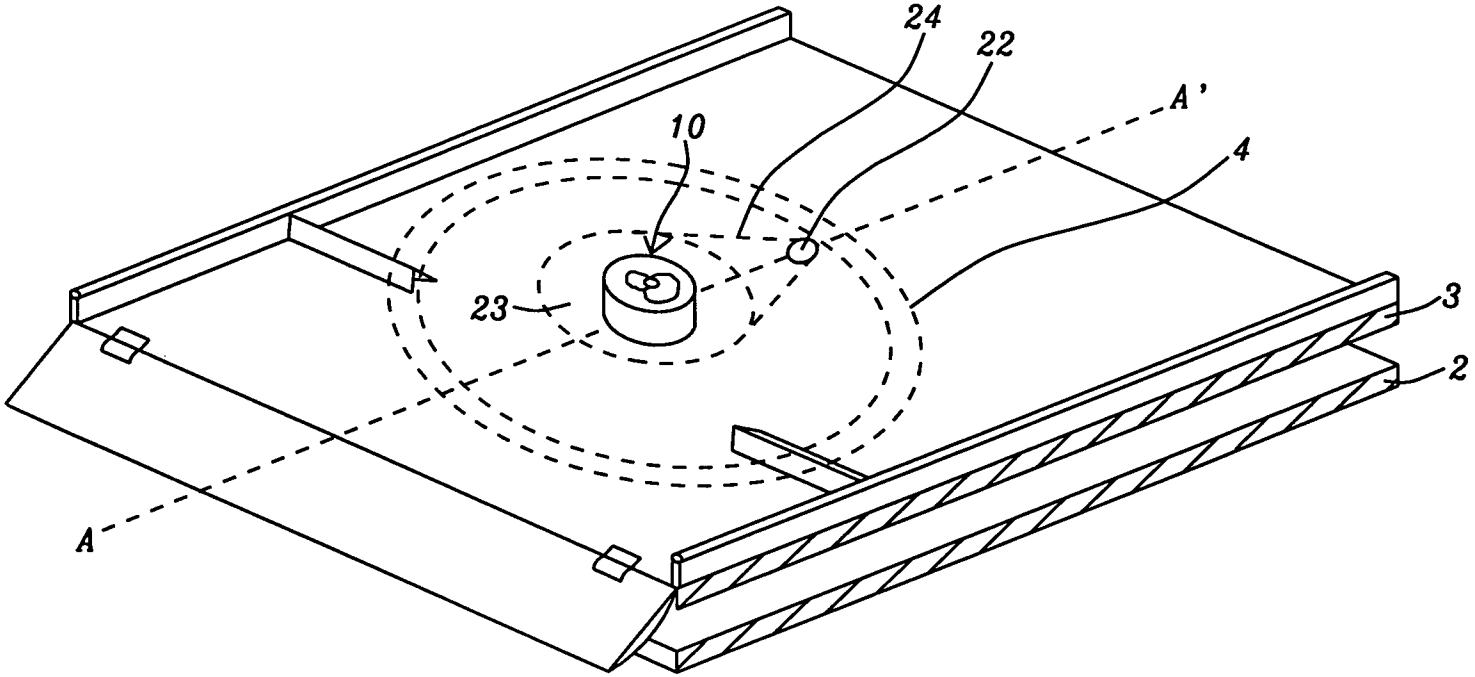
FIG. 2 is an isometric view of the turntable according to a first embodiment of the present invention illustrating, in phantom, the components beneath the top plate of the turntable.
Figure 3:
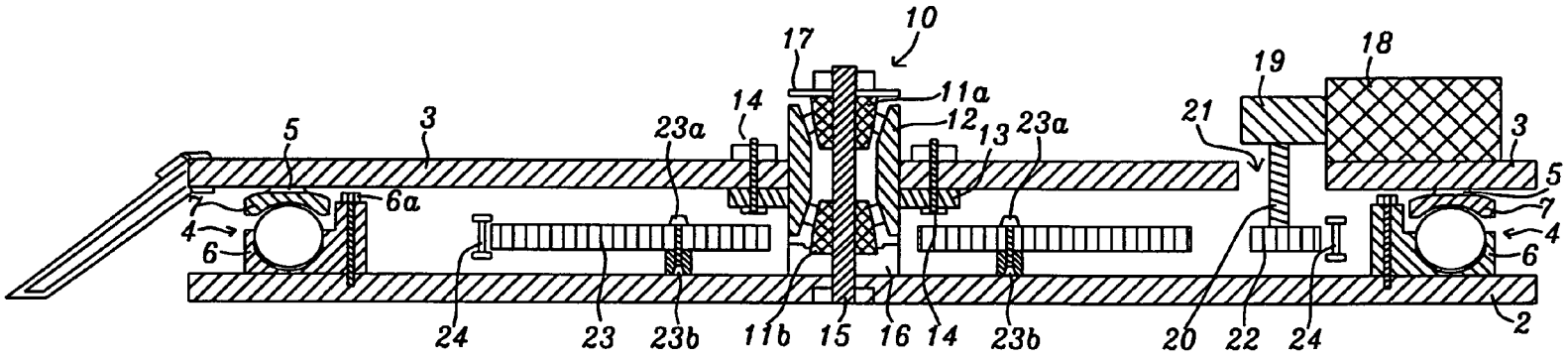
FIG. 3 is a cross section of the turntable according to a first embodiment of the present invention showing the relationship of the components between the stationary base plate and the rotatable top plate of the present invention in the cut defined by the line A-A' of FIGS. 1 and 2.

A preferred embodiment of this invention is illustrated in FIGS. 1-3. Referring first to FIG. 1, there is shown a platform 1 consisting of a stationary base plate 2 and a rotatable top plate 3. Plates 2 and 3 are preferably constructed of aluminum and have a thickness of ⅜ inch or thereabout and dimensions of about 2 feet in width and about 3 feet in length. These dimensions are determined by the size of the wheelchair to be accommodated. Alternatively, the plates 2 and 3 could be constructed of titanium or magnesium. The bottom (stationary) race 6 of a large circular ring thrust bearing 4, shown in phantom in FIG. 2 and in cross-section in FIG. 3, is secured to the bottom plate 2 by screws 6*a*. The upper plate 3 rests upon nylon, or alternately Teflon, pads 5 (shown in FIG. 3) which are fastened onto the top race 7 of the thrust bearing 4 with an adhesive.

The thrust bearing has a weight capacity of about 850-1000 pounds and is only about ¾ inches in height. The large bearing, almost the size of the platform width, works best in terms of weight support. The total platform height, including the upper and lower plates is then only about 1½ inches.

A bearing assembly 10 forming the hub of the rotatable upper plate 3 comprises a pair of conical roller bearings 11*a* and 11*b*. The outer race member 12 is common to both bearings 11*a* and 11*b* which is welded to mounting plate 13 which in turn is bolted to upper plate 3 by bolts 14. The conical roller bearings 11*a* and 11*b* are adjustably secured within the outer race member 12 by the central bolt 15. A protective cover 17 is provided to protect the bearing assembly from debris. The edges of cover 17 may be curved downward to further shield the bearings. Elevation block 16 aligns the bearings 11*a* and 11*b* with the upper plate 3 and provides not only spacing but also additional robustness to the bearing assembly 10.

The upper plate 3 is rotated by a reversible dc electric motor 18 which can be under the control of the wheelchair's occupant. Preferably, this is a 12-volt, 30-amp brush motor with gear drive and a 54:1 ratio. The motor 18 rotates a drive sprocket 22 through a gearbox 19 and shaft 20 through an opening 21 in the upper plate 3 (See also FIG. 1). A drive chain 24 connects the drive sprocket 22 to a larger sprocket 23 which is fixed to the lower stationary plate 2 by bolts 23*a* and spacers 23*b*. The motor/gearbox assembly is mounted onto the upper plate by bolts (not shown) through a slotted flange to permit tensioning of the chain 24.

It has been determined that with a large/small sprocket diameter ratio of 9.33 (using, as an example, a large sprocket size of about 14" and small sprocket of about 1.5"), driven by a 12 Volt motor provides a comfortable rotation speed of the platform. A 24 Volt battery/power supply was found to rotate the table too quickly. Smoothness of rotation is achieved using, for example, a #35 chain and a large sprocket having 114 teeth or thereabout.

Referring now to FIG. 1, there are illustrated additional optional features located on the top surface of the rotatable platform 3. These include side rails 30 which are preferably formed of aluminum and welded onto the plate 3, wheel stops 31 which serve to alert the wheelchair occupant when the chair is in proper on-board position, guard wall 33 which protects the motor 18 from damage by the wheelchair, and a ramp 32 which is fastened to the top plate 3 by hinges 32*a*. Because the overall height of the platform is only about 1½ inches, the ramp is optional. It need not be more than about 2-5 inches long and can be easily flipped up onto the upper plate after the wheelchair is on board. Optionally, a support made of, for example, a plastic composite, can be placed between the bottom plate 2 and top plate 3, attached to the top plate, running the width of the plates, adjacent to the ramp 32, and having a depth of about ¾". This support would prevent the top plate edge near the ramp from being undesirably forced down toward the bottom plate as the wheelchair is first driven onto the platform.

Figure 4:
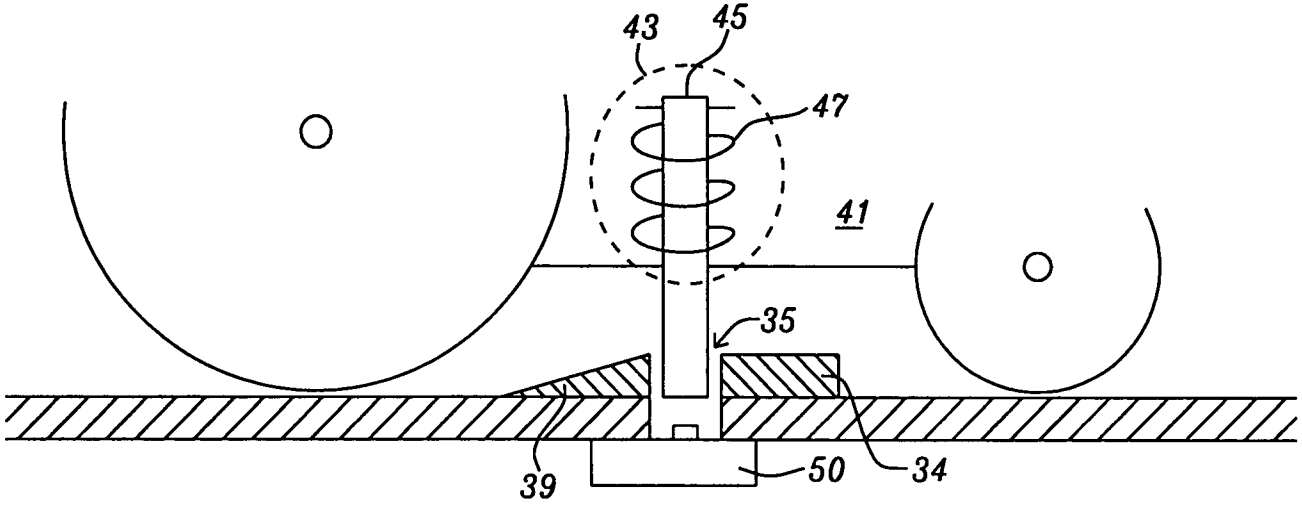
FIG. 4 is an isometric view of a portion of a wheelchair showing an optional fifth-wheel coupling apparatus.

An optional small fifth-wheel coupling receiver 34 is shown just ahead of the right wheelchair tire stop 31. This type of coupling allows a reasonable amount of error in the alignment of a wheelchair mounted hitch pin and the receiver on the turntable. FIG. 4 illustrates a portion of a wheelchair 41 having a fifth-wheel coupling apparatus 43. As the hitch pin 45 on the chair engages the coupling body 34, it is guided laterally towards the mounting hole 35 by the guide walls 37 of the coupling. At the same time, the pin 45 rises on a ramp 39 on the coupling body. When the pin reaches the mounting hole, it drops into the opening, thereby securing the wheelchair to the turntable. Preferably, the hitch pin is mounted flexibly on the wheelchair whereby the rising along the coupling ramp does not require lifting the chair but rather lifts only the pin against a spring 47 which then drives the pin into the mounting hole. Dismounting the chair is then accomplished by a solenoid 50, mounted under the mounting hole, which, when engaged, drives the pin out of the mounting hole.

In a second embodiment of this invention, the turntable is identical to the one described in the first embodiment except that it is powered by its own battery or other power supply. The turntable can then accommodate manual wheelchairs as well as powerchairs. Another advantage is that an ohmic power connector from the chair to the turntable is unnecessary. However, chin or other joystick control can still be transferred from the chair to the turntable at the moment the chair is latched thereto. This effectively disables the chair's battery preventing accidental movement of the chair while it is latched to the turntable.

Positioning the battery or power supply is arbitrary and it may be mounted next to the motor 18.

The present invention provide a design for a lightweight, high capacity, and portable wheelchair turntable wherein electrical power and control can be automatically transferred from a powerchair to the turntable when the powerchair engages the turntable and is returned to the powerchair when the occupant disengages the turntable. The rotatable platform of the invention can be mounted, engaged, operated, and dismounted, with ease and confidence, entirely under the control of a wheelchair-bound person. An important application is for a disabled person to use the turntable at a computer workstation. Another important application is for use in outdoor sporting activities such as hunting and fishing trips. Many other applications will be apparent to those skilled in the art and to users of the rotatable platform.

While the embodiment described supra includes only essential features of the turntable which are directed at functionality, there are additional features which may be incorporated on the platform which would make the turntable safer and more user friendly to the occupant.

While this invention has been particularly shown and described with reference to the preferred embodiments thereof, it will be understood by those skilled in the art that various changes in form and details may be made without departing from the spirit and scope of the invention.

What is claimed is:

1. A motorized rotatable platform for a wheelchair comprising:

a stationary bottom plate;

a rotatable top plate supported by a central conical bearing assembly and a circular ring thrust bearing, wherein rotation of said top plate is accomplished by an electric motor/gearbox assembly top-mounted at a front center position on said top plate wherein said electric motor rotates a small sprocket integrated with said motor/gearbox assembly and residing between said bottom plate and said top plate, but not attached to said bottom plate;

wherein said small sprocket drives a drive chain which also engages a large sprocket, said large sprocket being fastened securely to said bottom plate and wherein said electric motor/gearbox assembly is mounted onto said top plate through a slotted flange to permit tensioning of said drive chain, and wherein said motor is capable of being connected to and controlled by a chin controller or other joystick-type control; and a latch capable of locking a wheelchair to said rotatable top plate wherein said latch comprises:

a coupling receiver having a mounting hole therein mounted on said rotatable top plate, and guide walls on top surface of said coupling receiver guiding a hitch pin mounted on said wheelchair into said mounting hole wherein a spring drives said hitch pin into said mounting hole, wherein said locking of said wheelchair is capable of being performed independently by a user of said wheelchair.

2. The motorized rotatable platform of claim 1 wherein said top and bottom plates comprise aluminum, magnesium or titanium or an alloy thereof.

3. The motorized rotatable platform of claim 1 wherein said top plate rests upon pads fastened onto a top race of said circular ring thrust bearing.

4. The motorized rotatable platform of claim 1 wherein said circular ring thrust bearing has a weight capacity of between about 850 and 1000 pounds and is capable of supporting the weight of a powered wheelchair.

5. The motorized rotatable platform of claim 1 wherein said central conical bearing assembly forms the hub of said rotatable top plate and wherein said central conical bearing assembly comprises:

a pair of upper and lower conical roller bearings; and an outer race member common to both upper and lower conical roller bearings and fastened to a mounting plate which in turn is bolted to said rotatable top upper plate;

wherein said pair of conical roller bearings are adjustably secured within said outer race member by a central bolt also secured to said bottom plate.

6. The motorized rotatable platform of claim 5 further comprising a protective cover to protect said central conical bearing assembly from debris.

7. The motorized rotatable platform of claim 5 further comprising at least one elevation block located between said bottom plate and said pair of roller bearings to align said pair of roller bearings with said top plate.

8. The motorized rotatable platform of claim 1 wherein a bottom of said circular ring thrust bearing is secured to said bottom plate and wherein said top plate rests upon pads fastened onto a top of said circular ring thrust bearing.

9. The motorized rotatable platform of claim 1 wherein said top plate is rotated by a reversible dc electric motor controlled by an occupant of said wheelchair.

10. The motorized rotatable platform of claim 9 wherein said electric motor is powered by a battery used to power said wheelchair or by an external battery.

11. The motorized rotatable platform of claim 1 further comprising side rails attached to said top plate.

12. The motorized rotatable platform of claim 1 further comprising wheel stops attached to said top plate.

13. The motorized rotatable platform of claim 9 further comprising a guard wall attached to said top plate which protects said electric motor from damage by said wheelchair.

14. The motorized rotatable platform of claim 1 further comprising a ramp which is fastened to said top plate by hinges.

15. The motorized rotatable platform of claim 1 further comprising a solenoid mounted under said mounting hole, which, when engaged, drives said hitch pin out of said mounting hole thereby unlocking said wheelchair.

16. The motorized rotatable platform of claim 1 wherein said platform has a thickness of less than 2 inches.

17. A motorized rotatable platform for a wheelchair comprising:

a stationary bottom plate;

a rotatable top plate;

a central conical bearing assembly forming a hub of said rotatable top plate and wherein said central conical bearing assembly is adjustably secured within by a central bolt also secured to said bottom plate;

a circular ring thrust bearing fastened between said bottom plate and said top plate;

an electric motor/gearbox assembly top-mounted at a front center position on said top plate;

a small sprocket integrated with said motor/gearbox assembly and residing between said bottom plate and said top plate, but not attached to said bottom plate, driven by said electric motor/gearbox assembly;

a drive chain driven by said small sprocket;

a large sprocket engaged by said small sprocket, said large sprocket being fastened securely to said bottom plate wherein said electric motor/gearbox assembly is mounted onto said top plate through a slotted flange to permit tensioning of said drive chain, and wherein said motor is capable of being connected to and controlled by a chin controller or other joystick-type control; and a latch capable of locking said .wheelchair to said rotatable top plate wherein said latch comprises:

a coupling receiver having a mounting hole there in mounted on said rotatable top plate; and guide walls on a top surface of said coupling receiver capable of guiding a hitch pin mounted on said wheelchair into said mounting hole wherein a spring drives said hitch pin into said mounting hole: and wherein said locking of said wheelchair is capable of being performed independently by a user of said wheelchair.

18. The motorized rotatable platform of claim 17 wherein said electric motor is powered by a battery used to power said wheelchair or by an external battery.

19. The motorized rotatable platform of claim 17 further comprising a guard wall attached to said top plate which protects said electric motor from damage by said wheelchair.

20. The motorized rotatable platform of claim 17 further comprising a ramp which is fastened to said top plate by hinges.

21. The motorized rotatable platform of claim 17 further comprising a solenoid mounted under said mounting hole, when engaged, drives said hitch pin out of said mounting hole thereby unlocking said wheelchair.

22. A method for rotating a wheelchair on a motorized rotatable platform comprising:

providing said motorized rotatable platform comprising:

a stationary bottom plate; and a rotatable top plate supported by a central conical bearing assembly and a circular ring thrust bearing, wherein rotation of said top plate is accomplished by an electric motor/gearbox assembly top-mounted at a front center position on said top plate which drives a small sprocket integrated with said motor/gearbox assembly and residing between said bottom plate and said top plate, but not attached to said bottom plate; wherein said small sprocket drives a drive chain which also engages a large sprocket, said large sprocket being fastened securely to said bottom plate wherein said electric motor/gearbox assembly is mounted onto said top plate through a slotted flange to permit tensioning of said drive chain, and wherein said motor is capable of being connected to and controlled by a chin controller or other joystick-type control;

driving said wheelchair onto said motorized rotatable platform;

locking said wheelchair to said rotatable top wherein said locking comprises:

as said wheelchair driven onto said motorized rotatable platform, a locking portion of said wheelchair is guided into a coupling receiver mounted on said rotatable top plate wherein hitch pin is guided into a mounting hole in said coupling receiver; and a spring drives said hitch pin into id mounting hole:

thereafter switching electrical power from said wheelchair's electric motor to said electric motor/gearbox assembly;

rotating said wheelchair to a desired position using said wheelchair's controls to control said motorized rotating platform;

disengaging said locking of said wheelchair wherein a solenoid mounted adjacent said mounting hole drives said hitch pin out of said mounting hole;

thereafter switching electrical power from said electric motor/gearbox assembly to said wheelchair's electric motor; and driving said wheelchair off of said motorized rotatable platform, wherein said driving, locking, rotating, and disengaging said locking of said wheelchair is capable of being performed independently by user of said wheelchair.

* * * * *